US009388555B2

(12) United States Patent
Whitehead et al.

(10) Patent No.: US 9,388,555 B2
(45) Date of Patent: Jul. 12, 2016

(54) PLUMBING OUTLET BOX WITH INTEGRATED MOUNTING FEATURES

(71) Applicant: IPS Corporation, Collierville, TN (US)

(72) Inventors: James H. Whitehead, Collierville, TN (US); Jeffrey A. Humber, Memphis, TN (US)

(73) Assignee: IPS Corporation, Collierville, TN (US)

( * ) Notice: Subject to any disclaimer, the term of this patent is extended or adjusted under 35 U.S.C. 154(b) by 239 days.

(21) Appl. No.: 14/154,949

(22) Filed: Jan. 14, 2014

(65) Prior Publication Data

US 2015/0197923 A1 Jul. 16, 2015

(51) Int. Cl.
*E03C 1/02* (2006.01)
*D06F 39/08* (2006.01)

(52) U.S. Cl.
CPC ..... *E03C 1/021* (2013.01); *D06F 39/08* (2013.01); *D06F 39/088* (2013.01); *Y10T 137/698* (2015.04)

(58) Field of Classification Search
CPC ..... E03C 1/021; Y10T 137/698; D06F 39/08
USPC ..... 137/360, 361; 312/242, 229; 4/695; 248/57, 56; 52/34, 35; 220/3.3–3.6
See application file for complete search history.

(56) References Cited

U.S. PATENT DOCUMENTS 1,156,885 A 10/1915 Caine
3,096,782 A * 7/1963 Williams ..... E03B 9/00 137/360
3,834,781 A 9/1974 Logsdon
3,847,175 A 11/1974 Anderson
3,996,959 A 12/1976 Caruth
4,135,337 A 1/1979 Medlin
4,165,443 A * 8/1979 Figart ..... H02G 3/16 174/53
4,165,851 A 8/1979 Bowden, Jr. et al.
4,410,004 A 10/1983 Kifer et al.
4,564,249 A 1/1986 Logsdon
4,637,422 A 1/1987 Izzi, Sr.
4,716,925 A 1/1988 Prather
4,865,072 A 9/1989 Logsdon
4,934,410 A 6/1990 Humber
4,942,896 A * 7/1990 Slusser ..... E03C 1/01 137/360
5,025,944 A 6/1991 Rodick
5,050,632 A 9/1991 Means, Jr.
5,261,444 A 11/1993 Childers (Continued)

OTHER PUBLICATIONS

U.S. Appl. No. 13/909,728, filed Jun. 4, 2013; entitled *Plumbing Outlet Box*; first named inventor: Clarke.

(Continued)

*Primary Examiner* — Craig Schneider
*Assistant Examiner* — Josephine Trinidad-Borges
(74) *Attorney, Agent, or Firm* — Alston & Bird LLP

(57) ABSTRACT

Plumbing outlet boxes, such as for connecting washing machines, ice makers, and other plumbed appliances to plumbing systems, are provided that can be attached to each other without the use of separate connectors or mounting brackets. In particular, plumbing outlet boxes are described that include receiving features and mounting tabs extending outwardly from the side walls. The receiving features and mounting tabs are arranged such that the plumbing outlet box has rotational symmetry. In this way, receiving features may be engaged with mounting tabs of an adjacent plumbing outlet box regardless of the relative orientation of the mating plumbing outlet boxes.

14 Claims, 10 Drawing Sheets

(56) References Cited

U.S. PATENT DOCUMENTS

| | | | | |
|---|---|---|---|---|
| 5,538,033 | A | 7/1996 | Condon | |
| 5,696,350 | A * | 12/1997 | Anker | H02G 3/14 174/66 |
| 5,755,247 | A | 5/1998 | Condon | |
| 5,983,923 | A | 11/1999 | Hobbs et al. | |
| 6,101,780 | A | 8/2000 | Kreidt | |
| 6,125,881 | A | 10/2000 | Hobbs et al. | |
| 6,129,109 | A | 10/2000 | Humber | |
| 6,148,850 | A | 11/2000 | Kopp et al. | |
| 6,155,286 | A | 12/2000 | Geary | |
| 6,234,193 | B1 | 5/2001 | Hobbs | |
| 6,435,206 | B1 | 8/2002 | Minnick | |
| 6,845,785 | B1 | 1/2005 | Condon | |
| 7,357,148 | B1 * | 4/2008 | Gibson | E03C 1/021 137/360 |
| 7,360,553 | B1 | 4/2008 | Ismert | |
| 7,370,663 | B2 * | 5/2008 | Lundeberg | F16K 27/12 137/371 |
| 7,614,419 | B2 | 11/2009 | Minnick | |
| 7,735,511 | B1 | 6/2010 | Ismert | |
| 8,020,581 | B1 | 9/2011 | Julian et al. | |
| 2005/0251908 | A1 * | 11/2005 | Doverspike | E03C 1/042 4/695 |
| 2010/0000614 | A1 * | 1/2010 | Zahuranec | E03C 1/021 137/360 |
| 2014/0352798 | A1 | 12/2014 | Clarke et al. | |

OTHER PUBLICATIONS

Patent Examination Report No. 1 from corresponding Australian Patent Application No. 2015200130 dated Oct. 1, 2015.

Halo Recessed Lighting—Product Catalog [online] [retreived Dec. 10, 2015]. Retrieved from the Internet: <URL: http://www.cooperindustries.com/content/dam/public/lighting/resources/library/literature/Halo/ADV100800-Halo%20Recessed%20Catalog.pdf>. 308 pages.

Sioux Chef OxBox Washing Machine Outlet Box [online] [retrieved Nov. 15, 2013]. Retrieved from the Internet: <URL: http://www.siouxchief.com/products/supply/access/laundry-boxes/oxbox-washing-machine-outlet-box>. 3 pages.

IPS Water Tite—Dual Drain Washing Machine Outlet Boxes [online] [retrieved Jul. 11, 2014]. Retrieved from the Internet: <URL: https://web.archive.org/web/20040820021208/http://www.ipscorp.com . . .>. 3 pages.

IPS Water Tite—Angle Stop Boxes [online] [retrieved Jul. 11, 2014]. Retrieved from the Internet: <URL: https://web.archive.org/web/20040814035049/http://www.ipscorp.com . . .>. 2 pages.

Office Action for corresponding Canadian Application No. 2,877,399 dated Dec. 2, 2015.

Office Action for corresponding U.S. Appl. No. 14/536,222 dated Dec. 16, 2015.

Office Action for corresponding U.S. Appl. No. 14/682,645 dated Dec. 17, 2015.

Office Action received for U.S. Appl. No. 14/682,645 dated Mar. 28, 2016.

Notice of Allowance for U.S. Appl. No. 14/536,222 dated Mar. 18, 2016.

Office Action for Canadian Application No. 2,892,865 dated Mar. 10, 2016.

First Examination Report for corresponding New Zealand Patent Application No. 716881, dated Apr. 20, 2016.

Patent Examination Report No. 1 from corresponding Australian Patent Application No. 2015202798 dated Apr. 15, 2016.

Notice of Allowance for corresponding U.S. Appl. No. 14/536,222 dated Apr. 22, 2016.

* cited by examiner

PLUMBING OUTLET BOX WITH INTEGRATED MOUNTING FEATURES

FIELD OF THE INVENTION

The present invention relates generally to plumbing outlet boxes, such as outlet boxes for connecting washers, ice makers, and other equipment to plumbing systems.

BACKGROUND

Conventional plumbing outlet boxes are typically used as housings for connections to plumbing systems. A plumbing outlet box may be provided, for example, for connecting a washing machine to pipes running within the walls of a building that are designed to carry water (e.g., hot and cold water supply and drain connections). As another example, a plumbing outlet box may be provided to connect an ice maker of a refrigerator to a water supply. Plumbing outlet boxes are generally installed in the walls of a house or other climate-controlled building. Often more than one plumbing outlet box is needed in the same area, each with the capability of connecting to different appliances having different configurations and requirements.

Accordingly, there is a need in the art for plumbing outlet boxes that can be configured to accommodate different types of connections and are easy to install, separately and in combination with other plumbing outlet boxes.

BRIEF SUMMARY OF EXAMPLE EMBODIMENTS

Plumbing outlet boxes, such as for connecting washing machines, ice makers, and other plumbed appliances to plumbing systems, are therefore provided that can be attached to each other without the use of separate connectors or mounting brackets. In this regard, a plumbing outlet box is provided that is configured for mounting within a wall. The plumbing outlet box may comprise a housing including a top wall, a bottom wall, first and second side walls, and an opening providing access into an interior of the housing. The plumbing outlet box may further include a first receiving feature extending outwardly from the first side wall; a second receiving feature extending outwardly from the second side wall; a first mounting tab extending outwardly from the first side wall; and a second mounting tab extending outwardly from the second side wall. The first receiving feature may be located proximate the top wall, and the second receiving feature may be located proximate the bottom wall. The first mounting tab may be located proximate the bottom wall, and the second mounting tab may be located proximate the top wall. Each receiving feature may be configured to receive an engaging mounting tab of another plumbing outlet box, and each mounting tab may be configured to be received by an engaging receiving feature of another plumbing outlet box. The receiving features and the mounting tabs may be integral with the housing.

In some cases, each receiving feature may comprise a pair of lateral receiving arms and a main receiving arm disposed therebetween configured to opposingly engage the engaging mounting tab. The main receiving arm and a portion of each lateral receiving arm may define a receiving channel configured to receive the engaging mounting tab. Furthermore, each lateral receiving arm may define a ledge extending toward the other lateral receiving arm of the pair of lateral receiving arms, wherein a surface of the ledge proximate the main receiving arm is configured to support a corresponding surface of the engaging mounting tab.

In some embodiments, each of the lateral receiving arms and the main receiving arm may include an opening configured for receiving a fastener. Each mounting tab may include a slot configured for receiving a fastener. Additionally or alternatively, the main receiving arm may include a series of angled ridges configured to engage a series of complementary angled ridges on the engaging mounting tab.

In some cases, the top wall and the bottom wall of the housing may each include drain openings. At least one of the top wall or the bottom wall may also include a pair of laterally spaced openings configured to accommodate hot and cold water supply connections.

In other embodiments, a method of installing a plumbing outlet box assembly comprising at least two plumbing outlet boxes within a wall is provided. The method may include providing first and second plumbing outlet boxes, each having a housing that includes a top wall, a bottom wall, first and second side walls, and an opening providing access into an interior of the housing. A first receiving feature may extend outwardly from the first side wall; a second receiving feature may extend outwardly from the second side wall; a first mounting tab may extend outwardly from the first side wall; and a second mounting tab may extend outwardly from the second side wall. The first receiving feature may be located proximate the top wall and the second receiving feature may be located proximate the bottom wall. The first mounting tab may in turn be located proximate the bottom wall and the second mounting tab may be located proximate the top wall.

The method may include engaging the second plumbing outlet box housing to the first plumbing outlet box housing via engagement of one of the first or second mounting tabs of the second plumbing outlet box housing with a corresponding one of the first or second receiving features of the first plumbing outlet box housing and engagement of one of the first or second receiving features of the second plumbing outlet box housing with a corresponding one of the first or second mounting tabs of the first plumbing outlet box housing. The method may further include fastening at least one of the first plumbing outlet box housing or the second plumbing outlet box housing within the cutout.

In some cases, fastening at least one of the first or second plumbing outlet box housings within the cutout may comprise inserting a fastener through an opening on the respective receiving feature. Each receiving feature of the first and second plumbing outlet boxes may comprise a pair of lateral receiving arms and a main receiving arm disposed therebetween.

In some embodiments, fastening the first plumbing outlet box within the cutout may comprise inserting a fastener through an opening in the respective lateral receiving arms of the first plumbing outlet box and inserting a fastener through an opening in the main receiving arm of the first plumbing outlet box following engagement of the second plumbing outlet box housing to the first plumbing outlet box housing. Moreover, fastening the second plumbing outlet box within the cutout may comprise inserting a fastener through a slot in the mounting tab of the second plumbing outlet box and the opening in the corresponding main receiving arm of the first plumbing outlet box following engagement of the second plumbing outlet box housing to the first plumbing outlet box housing.

In still other embodiments, an assembly of plumbing outlet boxes is provided, where the assembly includes at least a first plumbing outlet box and a second plumbing outlet box. Each plumbing outlet box may be configured for mounting within a wall, and each may comprise a housing including a top wall, a bottom wall, first and second side walls, and an opening providing access into an interior of the housing. A first receiving feature may extend outwardly from the first side wall; a second receiving feature may extend outwardly from the second side wall; a first mounting tab may extend outwardly from the first side wall; and a second mounting tab may extend outwardly from the second side wall. The first receiving feature may be located proximate the top wall, and the second receiving feature may be located proximate the bottom wall. The first mounting tab may be located proximate the bottom wall, and the second mounting tab may be located proximate the top wall.

The second plumbing outlet box housing may be configured to be engaged with the first plumbing outlet box housing via engagement of one of the first or second mounting tabs of the second plumbing outlet box housing with a corresponding one of the first or second receiving features of the first plumbing outlet box housing and engagement of one of the first or second receiving features of the second plumbing outlet box housing with a corresponding one of the first or second mounting tabs of the first plumbing outlet box housing. Moreover, the first and second plumbing outlet box housings may be configured to be engaged to each other regardless of the relative orientation of the two plumbing outlet box housings. In some cases, the first and second plumbing outlet box housings may be similarly configured.

The second plumbing outlet box housing may be oriented 180° from the orientation of the first plumbing outlet box housing. Each receiving feature of the first and second plumbing outlet box housings may comprise a pair of lateral receiving arms and a main receiving arm disposed therebetween configured to opposingly engage a corresponding mounting tab of the other of the first or second plumbing outlet box housings. Furthermore, each of the lateral receiving arms and the main receiving arm of the first and second plumbing outlet box housings may include an opening configured for receiving a fastener, and each of the mounting tabs of the first and second plumbing outlet box housings may include a slot configured for receiving a fastener.

In still other embodiments, a faceplate is provided for mounting on a plumbing outlet box mounted within a cutout of a drywall panel. The faceplate may comprise a frame portion and a transverse extension extending inwardly from the frame portion toward an interior of the plumbing outlet box. The transverse extension may comprise at least one eyelet, and each eyelet may define a hole configured to receive a securing member therethrough.

Each eyelet may be configured to receive at least one cable tie therethrough for securing a drain hose in place. In some cases, the transverse extension may comprise a pair of eyelets.

BRIEF DESCRIPTION OF THE DRAWINGS

Figure 1:
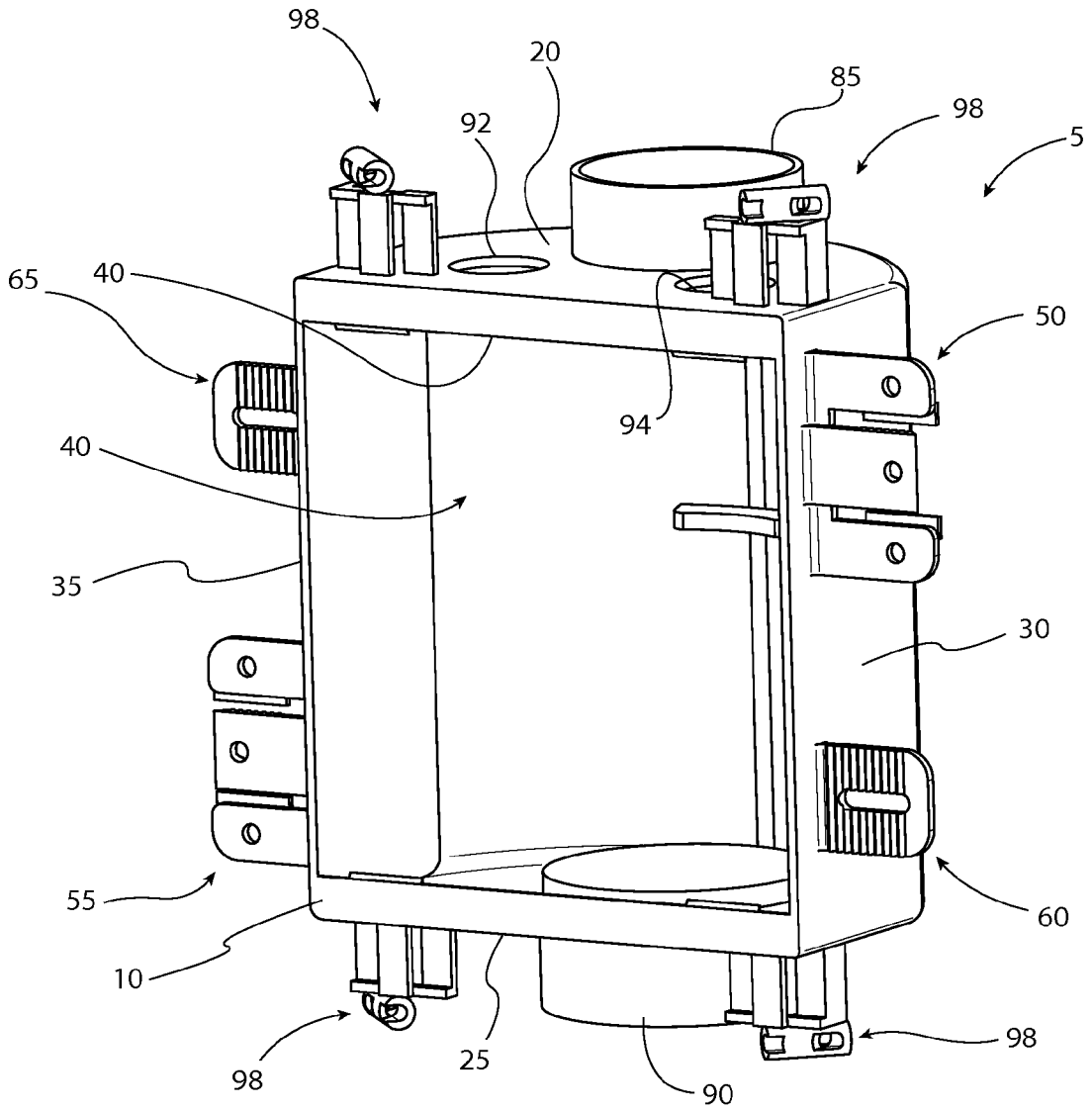
Figure 2:
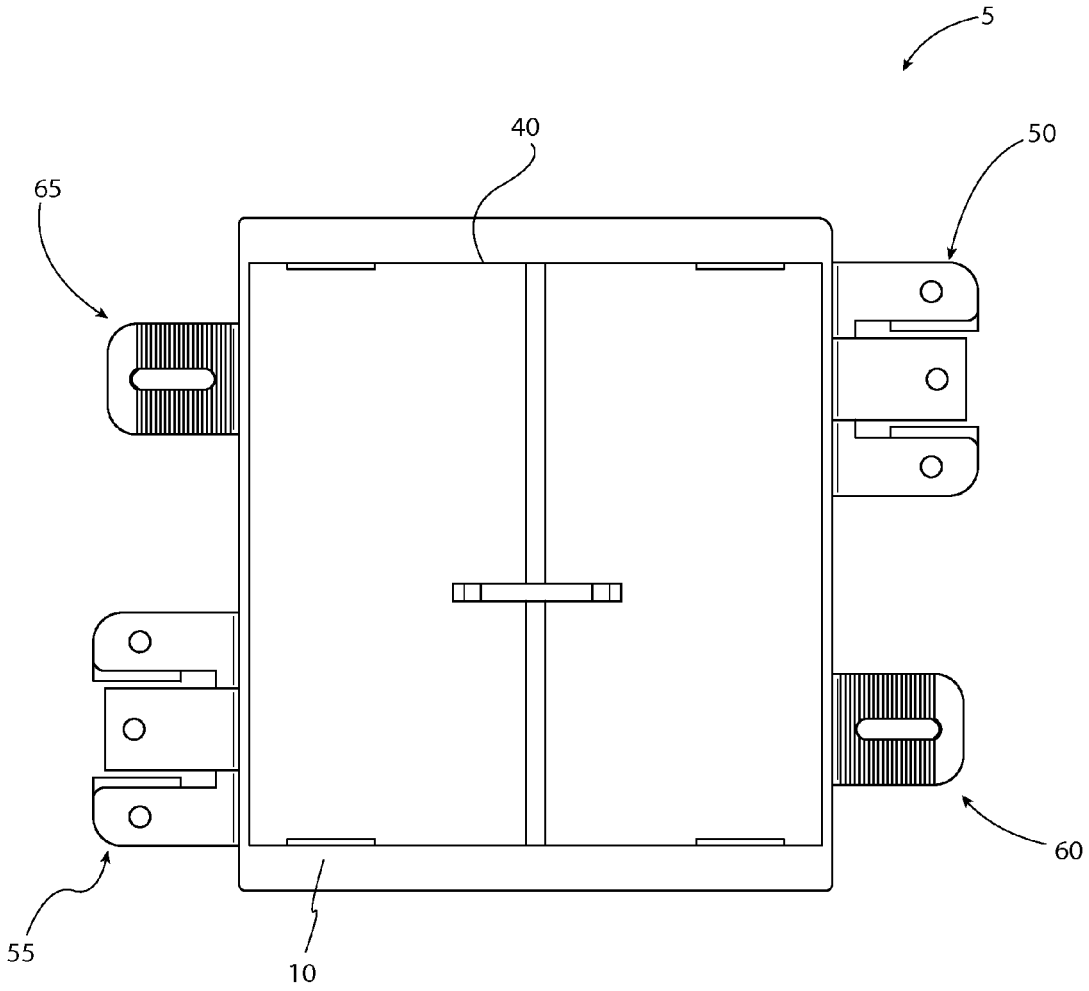
Figure 3:
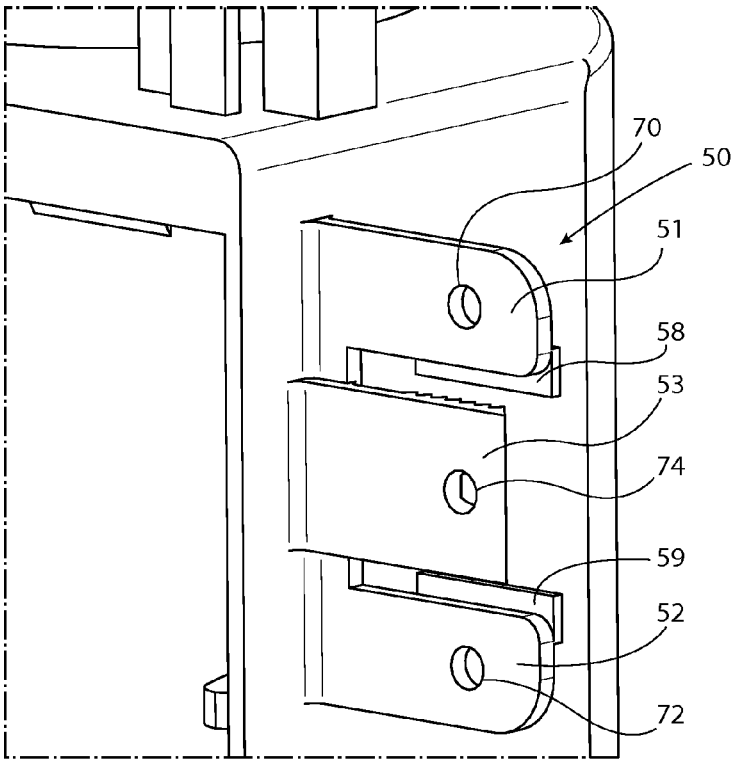
Figure 4:
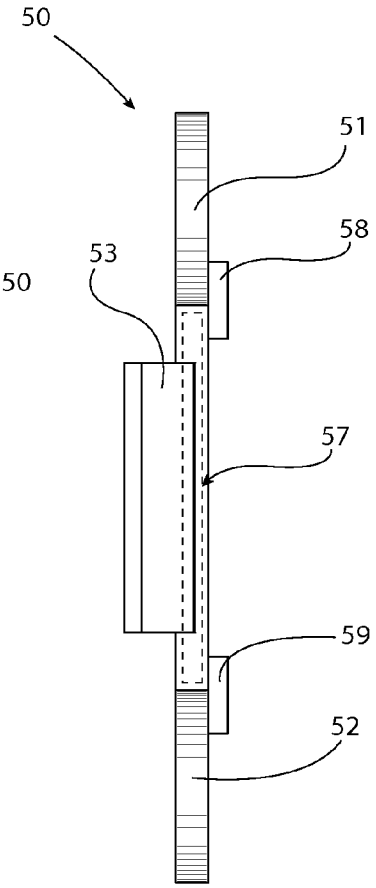
Figure 5:
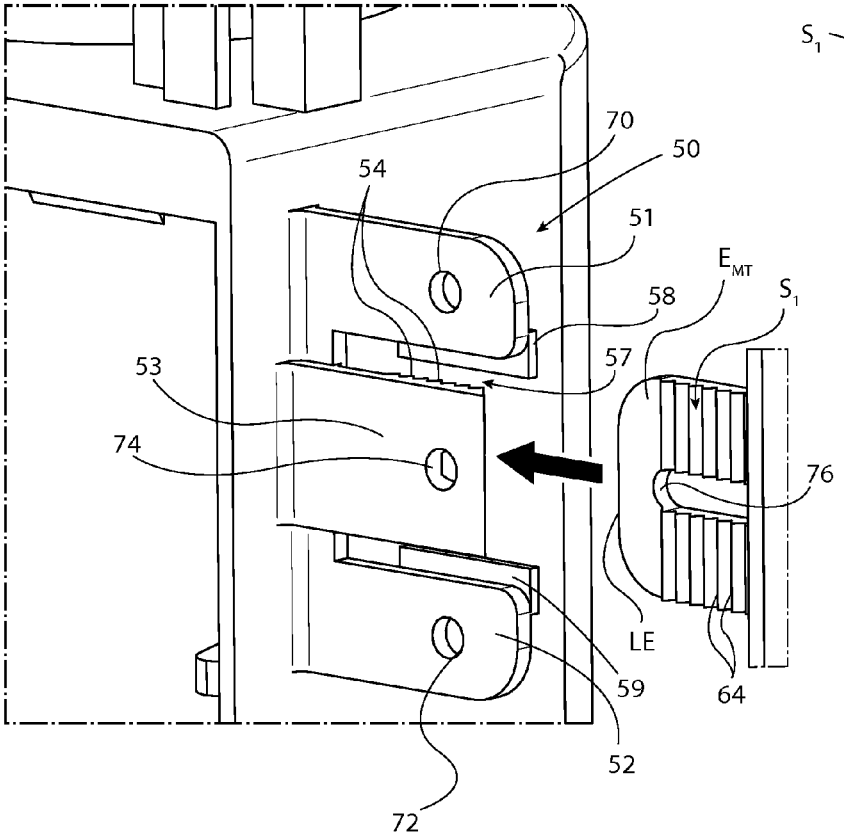
Figure 6:
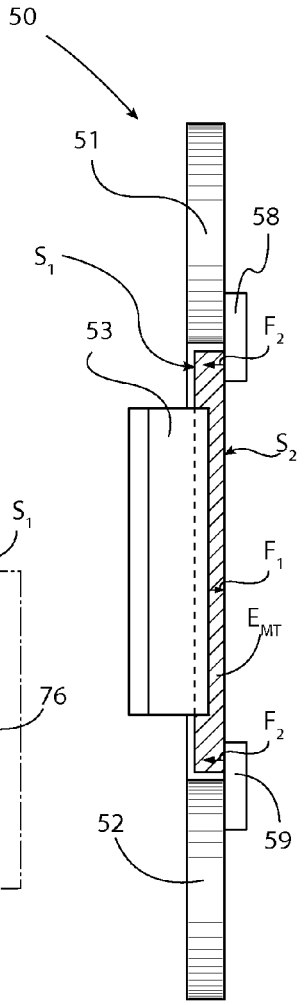
Figure 7:
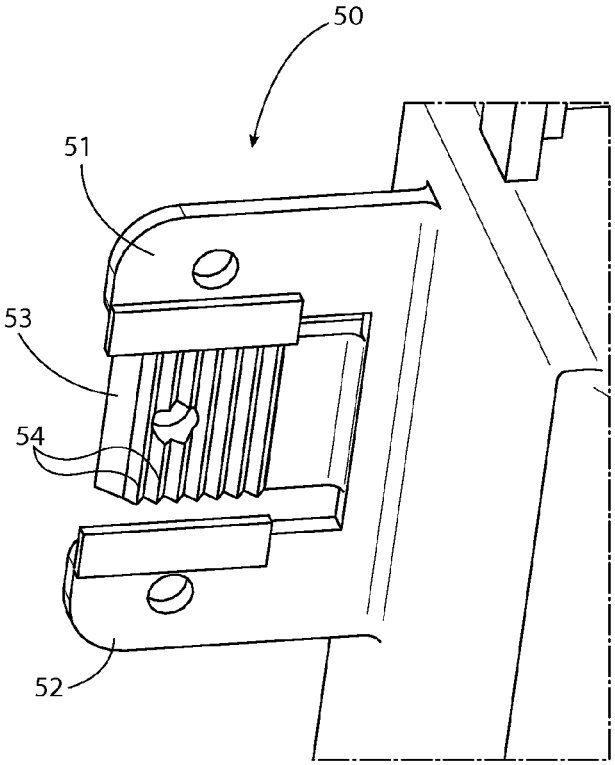
Figure 8:
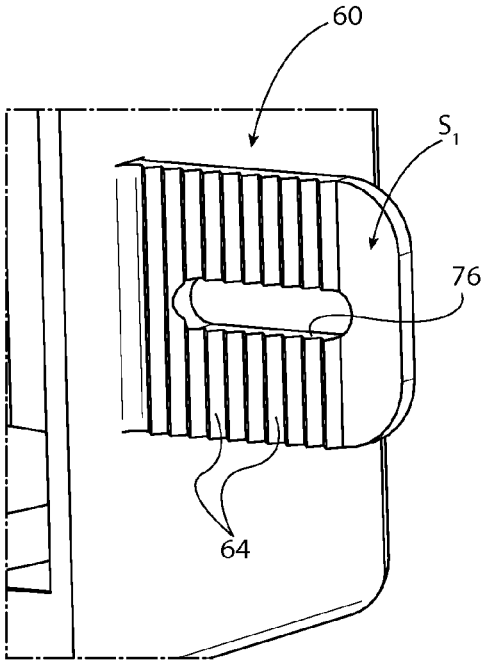
Figure 9:
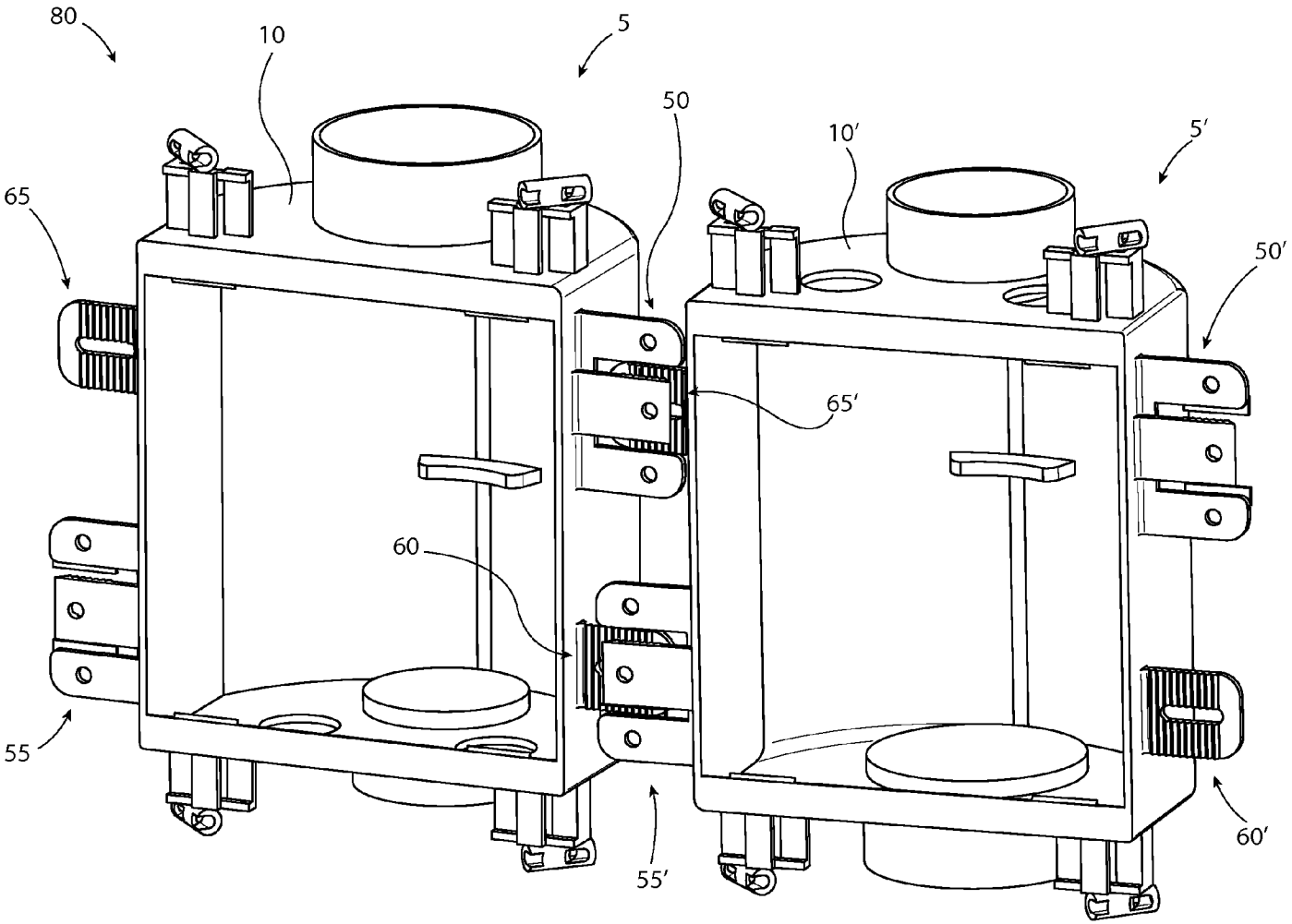
Figure 10:
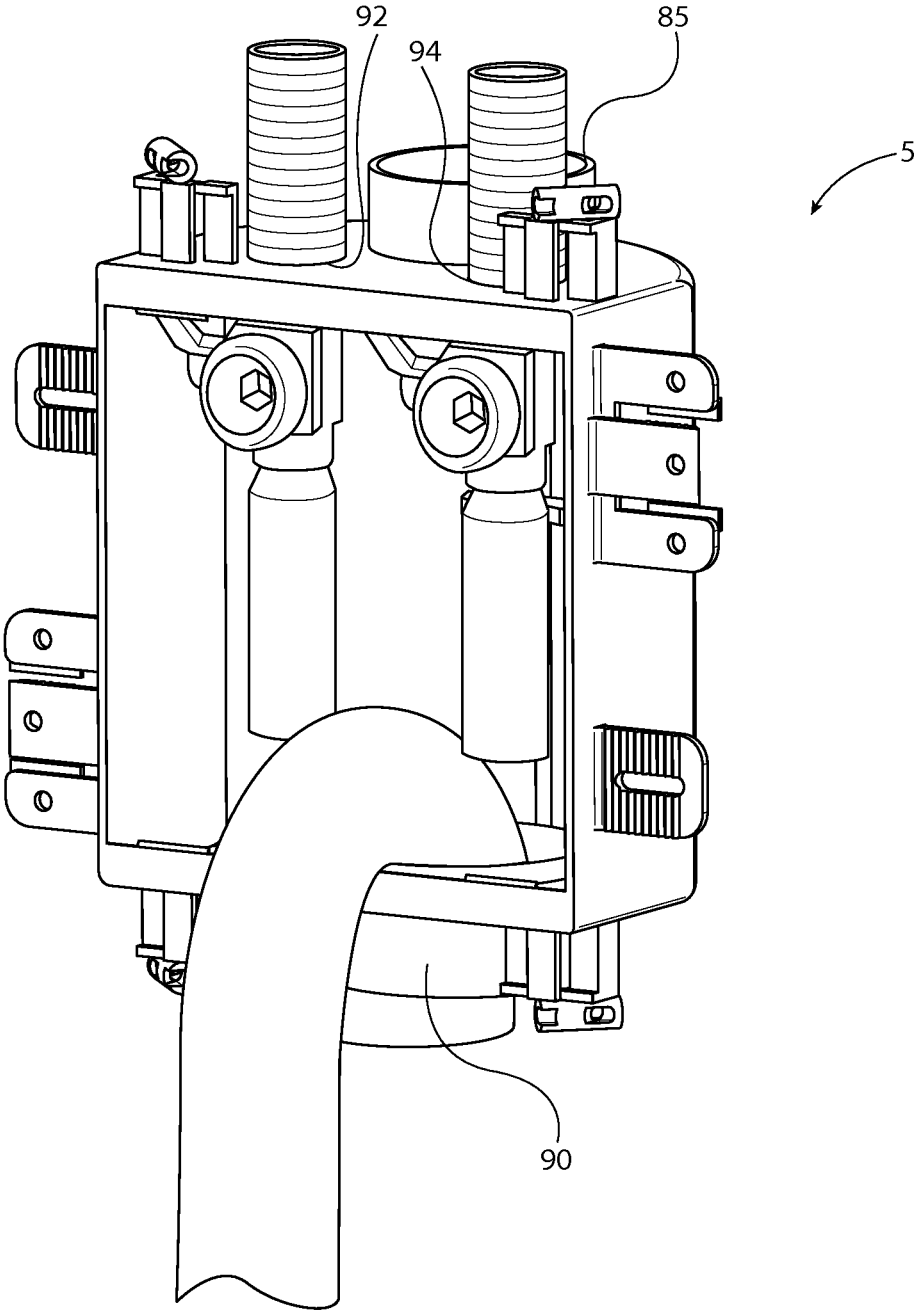
Figure 11:
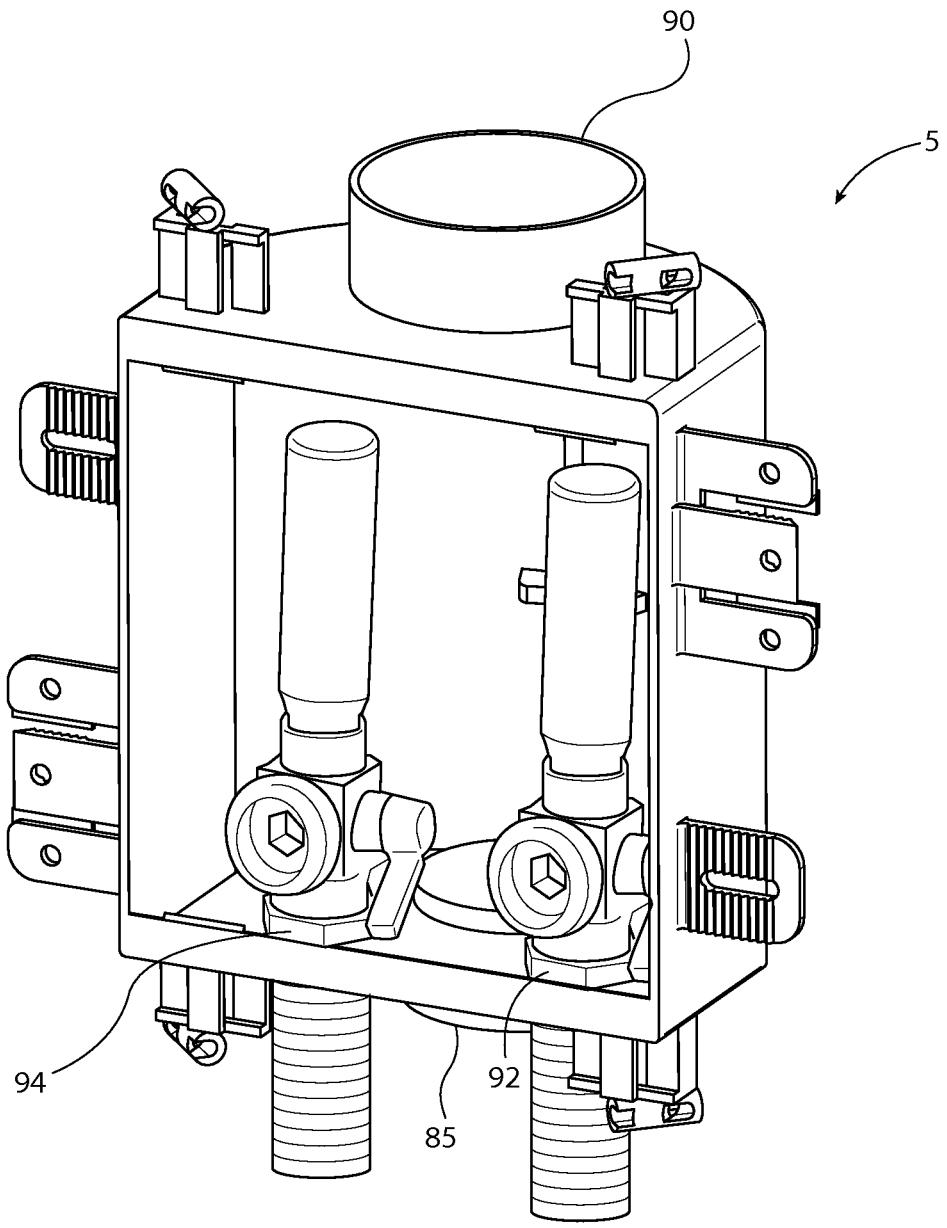
Figure 12:
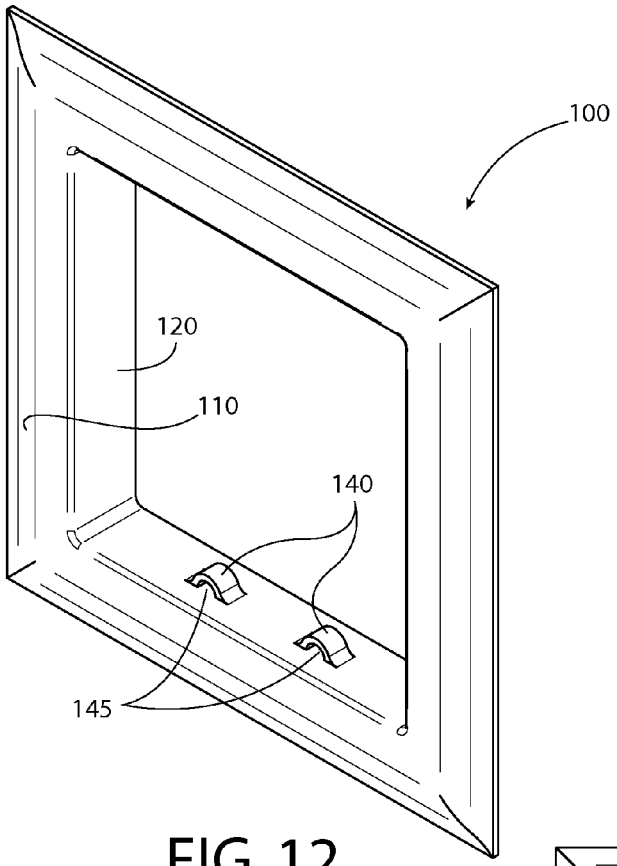
Figure 13:
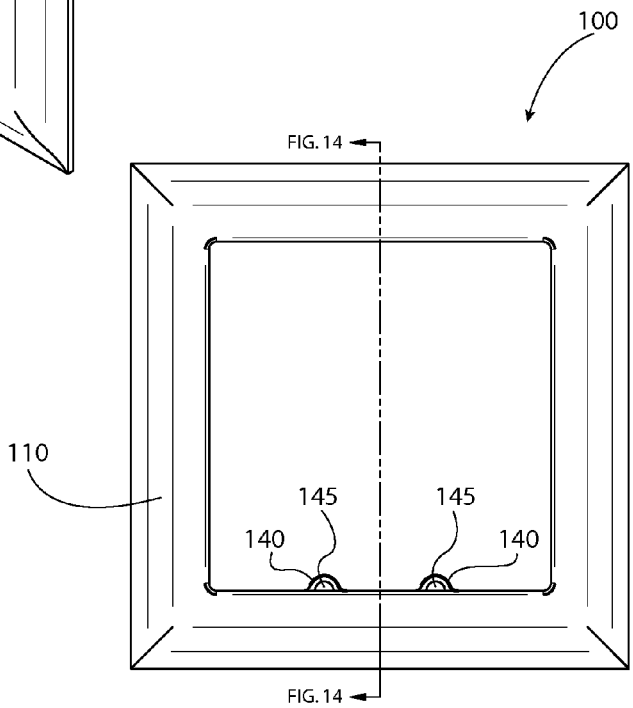
Figure 14:
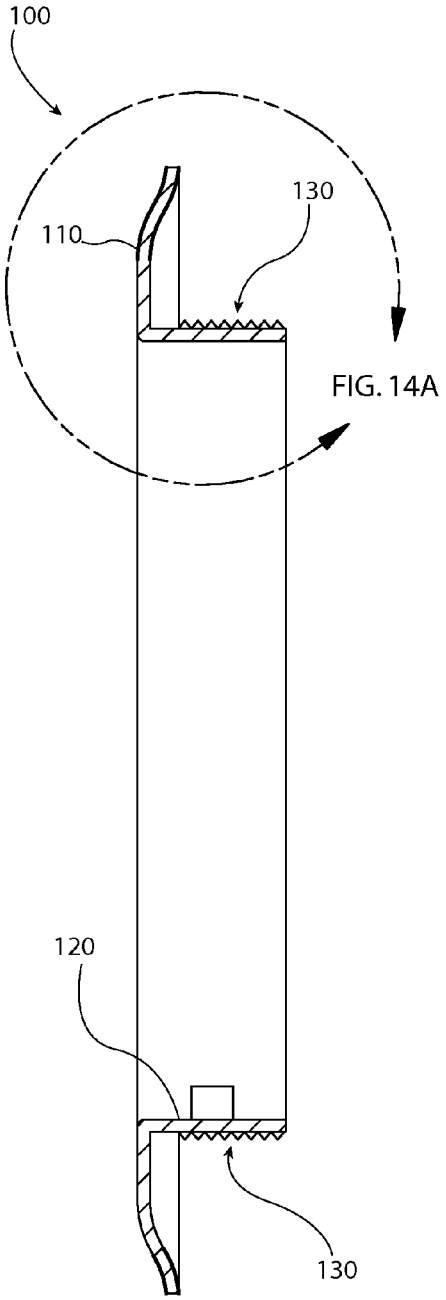

Having thus described the invention in general terms, reference will now be made to the accompanying drawings, which are not necessarily drawn to scale, and wherein:

FIG. 1 shows a perspective view of a housing of a plumbing outlet box in accordance with an exemplary embodiment of the present invention;

FIG. 2 shows a simplified front plan view of the plumbing outlet box of FIG. 1 in accordance with an exemplary embodiment of the present invention;

FIG. 3 shows a close-up perspective view, from the front, of a receiving feature of the plumbing outlet box of FIG. 1 in accordance with an exemplary embodiment of the present invention;

FIG. 4 shows a side view of the receiving feature of FIG. 3 in accordance with an exemplary embodiment of the present invention;

FIG. 5 shows a perspective view of the receiving feature of FIG. 3 and an engaging mounting tab of another plumbing outlet box in accordance with an exemplary embodiment of the present invention;

FIG. 6 shows a side view of the receiving feature of FIG. 3 engaged with an engaging mounting tab of another plumbing outlet box in accordance with an exemplary embodiment of the present invention;

FIG. 7 shows a close-up perspective view, from the back, of a receiving feature of the plumbing outlet box of FIG. 1 in accordance with an exemplary embodiment of the present invention;

FIG. 8 shows a close-up perspective view of a mounting tab of the plumbing outlet box of FIG. 1 in accordance with an exemplary embodiment of the present invention;

FIG. 9 shows a perspective view of an assembly of plumbing outlet boxes in accordance with an exemplary embodiment of the present invention;

FIG. 10 shows a perspective view the plumbing outlet box of FIG. 1 in a particular installation orientation in accordance with an exemplary embodiment of the present invention;

FIG. 11 shows a perspective view the plumbing outlet box of FIG. 1 in a different installation orientation in accordance with an exemplary embodiment of the present invention;

FIG. 12 shows a perspective view of a faceplate for a plumbing outlet box having eyelets in accordance with an exemplary embodiment of the present invention;

FIG. 13 shows a front plan view of the faceplate of FIG. 12;

FIG. 14 shows a side view of the faceplate of FIG. 12; and

Figure 14A:
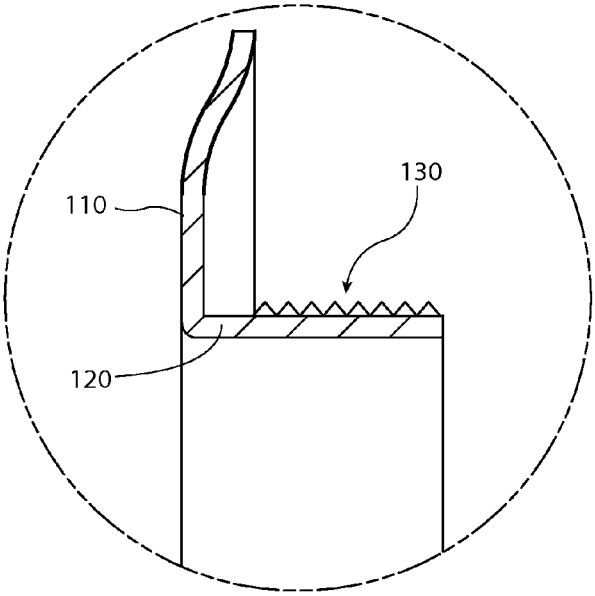

FIG. 14A shown a close-up view of a serrated ramp on a transverse portion of the faceplate of FIG. 14.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Some components of the plumbing outlet box and associated systems are not shown in one or more of the figures for clarity and to facilitate explanation of embodiments of the present invention.

As used herein, the terms "bottom," "top," "upper," "lower," "interior," "exterior," and similar terms are used for ease of explanation and refer generally to the position of certain components of embodiments of the described invention in the installed configuration (e.g., in an operational configuration). It is understood that such terms are not used in any absolute sense, and, as such, a component described as a "bottom wall" may be on the same level (e.g., at the same distance from the ground) as another component described as a "side wall" in certain configurations of embodiments of the described invention, such as when the plumbing outlet boxes are laying on a flat surface prior to installation as opposed to held within a wall, as described below. Moreover, in some embodiments, the plumbing outlet boxes described herein may be configured to be installed in more than one orientation to accommodate different types of connections. For example, in one installation scenario, one end of the plumbing outlet box may be disposed such that it forms an "upper" or "top" wall of the housing (closer to the ceiling), whereas in another installation scenario that same end of the plumbing outlet box may be disposed such that it forms a "lower" or "bottom" wall of the housing (closer to the floor).

Moreover, although the examples used below refer primarily to plumbing outlet boxes for providing washing machines with access to a hot and cold water supply and/or to a drain, embodiments of the present invention may further be applicable to plumbing outlet boxes for other applications and in other contexts (e.g., for an ice maker, dishwasher, sink and toilet angle stop, etc.), as noted above.

Plumbing outlet boxes are typically installed within a wall of the building, such as a house, apartment building, office building, or other residence or dwelling, in a manner such that the box is accessible to a resident or caretaker (e.g., a plumber) when necessary (e.g., for installation, maintenance, or trouble shooting) and at the same time is not obtrusive to the resident's every day activities. In this regard, a hole is typically cut into the sheet rock of the building wall that is sized to provide access to the plumbing outlet box, and the box is installed within the appropriately sized hole. A faceplate may be applied to the front face of the plumbing outlet box to improve the aesthetics of the plumbing outlet box (e.g., by providing a finished look and hiding the internal components of the box).

The housing of a conventional plumbing outlet box is generally configured to hold certain supply connections (plumbing shut-offs, valves, pipes, and/or fittings). As noted above, depending on the particular purpose of the plumbing outlet box (e.g., for connecting hot and cold water and a drain to a washing machine versus providing water for an ice maker), the type and/or number of connections that must be accommodated by the plumbing outlet box can vary. For example, in one scenario, such as when the plumbing outlet box is used for a washing machine installation, the plumbing outlet box may need to be configured to connect to a hot water source, a cold water source, and a drain. Moreover, depending on the available connections, the hot and cold water sources may be disposed such that the connections must be made via a bottom wall of the housing next to a drain connection in one case, whereas in another case the hot and cold water connections must be made via a top wall of the housing, opposite the drain connection.

As another example, in a scenario in which the plumbing outlet box is used for an ice maker installation, the plumbing outlet box may require only a single opening for connecting to a source of water, such as via the bottom wall of the housing. In still other cases, multiple plumbing outlet boxes may be required. In such cases, for example, two plumbing outlet boxes may need to be positioned next to each other, such as on opposite sides of a stud in the wall. The strength of the installation (e.g., to keep the plumbing outlet boxes properly positioned and supporting the connections) may, in some cases, depend on the strength of the connection between each outlet box and the wall stud, instead of or in addition to the strength of the connection between the plumbing outlet boxes themselves.

Thus, in conventional installations, differently configured plumbing outlet boxes (e.g., plumbing outlet boxes having different sizes and/or that include a different number, size, type, and/or location of openings for making certain plumbing connections) may be required depending on the type of installation the plumbing outlet box is to be used for. Providing different options of plumbing outlet boxes may require increased tooling and manufacturing costs, as well as additional costs and headaches related to shipping and inventory. Moreover, installation of the plumbing outlet boxes may be complicated when the correct configuration of plumbing outlet box is not chosen, is not in stock, or is otherwise unavailable. Furthermore, in some conventional installations in which two or more outlet boxes are to be located next to each other, additional brackets, mounts, connectors, and other accessories may be required to complete the installation in a proper manner, which can also add to the costs, require additional up-front planning time, and make such installations more complicated to perform.

Accordingly, embodiments of the invention provide a plumbing outlet box that is configured for mounting within a wall, where the box has a universal configuration that can accommodate various types of connections for different installation scenarios. In particular, embodiments of the plumbing outlet box are configured with first and second mounting tabs and first and second receiving features extending from respective walls of the housing of the plumbing outlet box in such a manner that each receiving feature is able to receive and engage a mounting tab of an identically or similarly configured plumbing outlet box. At the same time, each mounting tab is able to be received by and engage a receiving feature of an identically or similarly configured plumbing outlet box. In this way, two plumbing outlet boxes may be engaged with each other without the use of separate fasteners, accessories, mounts, or brackets, and the plumbing outlet boxes may further be able to engage with each other regardless of the specific orientation of the plumbing outlet boxes, such that the plumbing outlet boxes may have different orientations to accommodate different connections, while still being able to engage one another.

Turning to FIG. 1, a plumbing outlet box 5 is shown that is configured to be mounted within a wall (not shown). The plumbing outlet box 5 may comprise a housing 10 that includes a top wall 20, a bottom wall 25, a first side wall 30, and a second side wall 35. The housing 10 may define an opening 40 that provides access to an interior 45 of the housing.

With continued reference to FIG. 1, the plumbing outlet box 5 may further include a first receiving feature 50 extending outwardly from the first side wall 30 and a second receiving feature 55 extending outwardly from the second side wall 35. Similarly, a first mounting tab 60 may extend outwardly from the first side wall 30, and a second mounting tab 65 may extend outwardly from the second side wall 35. The receiving features 50, 55 and the mounting tabs 60, 65 may be integral with the housing (e.g., integrally molded from the same plastic material, such as polyvinyl chloride (PVC)) in some cases.

Receiving features 50, 55 of one plumbing outlet box may be configured to receive and engage with mounting tabs 60, 65 of another plumbing outlet box, such that two plumbing outlet boxes may be attached to each other in a side-by-side manner (e.g., as shown in FIG. 9 and described in greater detail below) by connecting a receiving feature and a mounting tab extending from one side of one of the plumbing outlet boxes with a corresponding mounting tab and receiving feature extending from a corresponding side of the other plumbing outlet box.

As such, each receiving feature 50, 55 (shown in FIG. 1) may be configured to receive a mounting tab of another plumbing outlet box (e.g., where the mounting tab of the other plumbing outlet box is configured as shown and described herein with respect to the first and second mounting tabs 60, 65). Likewise each mounting tab 60, 65 may be configured to be received by a receiving feature of another plumbing outlet box (e.g., where the receiving feature of the other plumbing outlet box is configured as shown and described herein with respect to the first and second receiving features 50, 55). The engagement of receiving features with mounting tabs is described in greater detail below. For ease of explanation, the mounting tabs and receiving features of the other plumbing outlet boxes are referenced herein as "engaging" mounting tabs and "engaging" receiving features.

As illustrated in FIG. 1, the first receiving feature 50 may be located proximate the top wall 20 and the second receiving feature 55 may be located proximate the bottom wall 25, while the first mounting tab 60 may be located proximate the bottom wall 25 and the second mounting tab 65 may be located proximate the top wall 20. Said differently, the first and second receiving features 50, 55 may be disposed near one pair of opposite corners of the plumbing outlet box 5 with respect to each other. Likewise, the first and second mounting tabs 60, 65 may be disposed near the other pair of opposite corners of the plumbing outlet box 5 with respect to each other.

Thus, considering only the placement of the receiving features 50, 55 and the mounting tabs 60, 65 about the perimeter of the opening 40 (e.g., as shown in the simplified front plan view of FIG. 2), the receiving features and mounting tabs are placed so as to impart rotational symmetry to the plumbing outlet box 5 with respect to the view shown in FIG. 2. As a result of this rotational symmetry (e.g., 2-fold rotational symmetry as shown), a rotation of 180° of the view shown in FIG. 2 results in the same relative position of the receiving features and mounting tabs. Thus, as described in greater detail below, an assembly of outlet boxes may be placed in side-by-side fashion and engaged via engagement of the corresponding receiving features 50, 55 and mounting tabs 60, 65, regardless of whether the top wall 20 of the housing is facing up (as shown in FIG. 1) or facing down (e.g., rotated 180° from the view shown in FIG. 1).

Turning now to FIG. 3, a close-up view of a receiving feature (e.g., the first receiving feature 50) according to an example embodiment is shown. In this regard, in some embodiments, each receiving feature 50, 55 may comprise a pair of lateral receiving arms 51, 52 and a main receiving arm 53 disposed therebetween that are configured to opposingly engage the engaging mounting tab (e.g., a corresponding mounting tab from another plumbing outlet box to be connected to the subject plumbing outlet box). For example, with reference to FIGS. 4 and 5, the main receiving arm 53 and a portion of each lateral receiving arm 51, 52 may be configured to define a receiving channel 57 (indicated by dashed lines) that is configured to receive the engaging mounting tab (in a direction into the page according to the depiction shown in FIG. 4). In other words, and with reference to FIG. 5, movement of an engaging mounting tab $E_{MT}$ towards the corresponding receiving feature 50 and into the receiving channel 57 may, in some embodiments, result in engagement of the receiving feature 50 with the corresponding mounting tab $E_{MT}$ by virtue of a leading edge LE of the engaging mounting tab, in a sense forcing its way between the main receiving arm 53 and the two lateral receiving arms 51, 52, each of which may be biased towards a neutral position (shown in FIG. 4, in which no mounting tab has been received).

In this way, once the engaging mounting tab $E_{MT}$ is received by the receiving feature 50, the main receiving arm 53 (as a result of its tendency toward the neutral position of FIG. 4) may apply a first holding force $F_1$ to the engaging mounting tab $E_{MT}$, while the lateral receiving arms 51, 52 may apply second holding forces $F_2$ to the engaging mounting tab $E_{MT}$. Thus, as shown in FIG. 6, the first and second holding forces $F_1$ and $F_2$ may be applied to the engaging mounting tab $E_{MT}$ in opposite directions with respect to each other. A combination of the first and second forces may therefore serve to retain the engaging mounting tab $E_{MT}$ within the receiving channel 57 (shown in FIG. 4) and in between the opposed main receiving arm 53 and the lateral receiving arms 51, 52.

Accordingly, in some embodiments, each lateral receiving arm 51, 52 may further define a ledge 58, 59 extending from the respective lateral receiving arm and toward the other lateral receiving arm of the pair of lateral receiving arms (e.g., toward the main receiving arm 53). A surface of each ledge 58, 59 proximate the main receiving arm 53 (best shown, for example, in FIG. 5) may be configured to support a corresponding surface of the engaging mounting tab $E_{MT}$. Thus, a portion of a first surface S1 (e.g., shown in FIG. 5) of the engaging mounting tab $E_{MT}$ may be configured to engage the main receiving arm 53 of the receiving feature 50 once received by the receiving feature, while portions of the second surface S2 (e.g., shown in FIG. 6) of the engaging mounting tab may be configured to engage the corresponding surfaces of the ledges 58, 59. Moreover, the ledges 58, 59 may further provide a guide for receiving the engaging mounting tab $E_{MT}$ within the receiving channel 57 (FIG. 4), such that as the engaging mounting tab is moved into engagement with the receiving feature 50 as shown in FIG. 5, vertical movement (e.g., with respect to the view shown in FIG. 5) of the engaging mounting tab may be limited by the interface between the ledges 58, 59 and the rest of the lateral receiving arms 51, 52, and the engaging mounting tab may be more smoothly received by and engaged with the corresponding receiving feature.

To allow for more secure engagement between the receiving features 50, 55 and the engaging mounting tabs $E_{MT}$, in some embodiments, the main receiving arm 53 of each receiving feature 50, 55 may include a series of angled ridges 54 configured to engage a series of complementary angled ridges 64 on the engaging mounting tab $E_{MT}$. A mounting tab 60 having a series of complementary angled ridges 64 on its first surface $S_1$ is shown in a close-up view in FIG. 8. The angled ridges 54, 64, may, in some cases, be configured (e.g., sized, shaped, angled, etc.) as shown in FIG. 5, such that movement of the engaging mounting tab $E_{MT}$ in a direction towards full engagement with the corresponding receiving feature 50, 55 (e.g., in the direction represented by the arrow in FIG. 5) is allowed, whereas movement in the opposite direction is resisted. In this way, the angled ridges 54, 64 may provide a ratchet-type engagement of the receiving feature 50, 55 with the corresponding engaging mounting tab $E_{MT}$. In some cases, for example, disengagement of the engaging mounting tab $E_{MT}$ may only be possible upon the application of a force in a direction perpendicular to the direction of engagement (e.g., a force that moves the main receiving arm 53 away from the lateral receiving arms 51, 52).

Turning again to FIG. 3, in some embodiments, the lateral receiving arms 51, 52 and/or the main receiving arm 53 may include respective openings 70, 72, 74 configured for receiving a fastener, such as a nail, bolt, screw, etc. In this regard, one or more fasteners (not shown) may be inserted through the corresponding openings 70, 72, 74 in the receiving feature 50 to mount the plumbing outlet box 5 within a wall, such as by securing the plumbing outlet box to wooden beams or studs (wood or metal) behind the drywall panel. In some cases, each mounting tab 60, 65 may also include one or more openings configured for receiving a fastener. For example, as shown in FIG. 8, the mounting tabs 60, 65 may include a slot 76 configured for receiving a fastener. In cases in which two or more plumbing outlet boxes 5 are attached to each other via corresponding receiving features 50, 55 and mounting tabs 60, 65, such as the receiving feature 50 and engaging mounting tab $E_{MT}$ shown in FIG. 5, the assembly of plumbing outlet boxes may be attached to one or more studs within a cutout of a drywall panel by passing a fastener through the opening 74 in the main receiving arm 53 and through the slot 76 of the engaging mounting tab $E_{MT}$. Because the opening in the mounting tab is configured as a slot 76, a fastener may be accommodated at various degrees of engagement between the receiving feature 50 and the engaging mounting tab $E_{MT}$. In other words, rather than having to align the opening 74 (which may be circular) with another circular opening in the engaging mounting tab $E_{MT}$, the presence of a slot 76 provides a range of tolerance that allows the fastener to be received by the main receiving arm 53 and the engaging mounting tab $E_{MT}$ at various positions of engagement.

Moreover, as a result of the adjustability provided by the angled ridges 54, 64 and the slot 76 of the mounting tabs 60, 65, the joining of two plumbing outlet boxes 5 may be made in such a manner as to allow the plumbing outlet boxes to be mounted to various sizes of studs. For example, older homes may have wood studs that are 2-inches wide, whereas newer homes may have wood studs that are only 1⅝-inches wide. Still other homes may use metal studs that are only 1½-inches wide. By engaging the receiving features 50, 55 and mounting tabs 60, 65 to the appropriate degree of engagement (e.g., by engaging a greater or fewer number of the angled ridges 54, 64), such variations in the sizes of the studs may be accommodated.

In addition to fastening the plumbing outlet box housings using the openings 70, 72, 74 of the receiving features 50, 55 (FIG. 3) and/or the slot 76 of the mounting tabs 60, 65 (FIG. 8), in some embodiments (e.g., shown in FIG. 1), additional mounting brackets 98 may be provided, such as at the top and bottom walls 20, 25. For example, as shown in FIG. 1, the mounting brackets 98 may be angled to receive a fastener at an angle so as to allow the fastener to extend both interiorly (in a direction into the cutout) and outwardly (in a direction away from the plumbing outlet box), such that the fastener may engage a structure of the cutout (e.g., a stud) disposed near the plumbing outlet box 5.

Turning now to FIG. 9, embodiments of the plumbing outlet box 5 (e.g., shown in FIG. 1) as described above may be attached to each other via corresponding receiving features 50, 55 and mounting tabs 60, 65 to form an assembly 80 of plumbing outlet boxes 5, 5'. In this regard, the assembly 80 may include at least a first plumbing outlet box 5 and a second plumbing outlet box 5', each configured for mounting within a wall, and each configured as described above with respect to FIGS. 1-8. Each plumbing outlet box 5, 5' may thus comprise a housing including a top wall, a bottom wall, first and second side walls, and an opening providing access into an interior of the housing. A first receiving feature may extend outwardly from the first side wall; a second receiving feature may extend outwardly from the second side wall; a first mounting tab may extend outwardly from the first side wall; and a second mounting tab may extend outwardly from the second side wall. As described above with respect to FIGS. 1-8, the first receiving feature may be located proximate the top wall and the second receiving feature may be located proximate the bottom wall. Similarly, the first mounting tab may be located proximate the bottom wall and the second mounting tab may be located proximate the top wall.

With reference to FIG. 9, the housing 10' of the second plumbing outlet box 5' may be configured to be engaged with the housing 10 of the first plumbing outlet box 5 via engagement of one of the first or second mounting tabs 60', 65' of the second plumbing outlet box housing 10' with a corresponding one of the first or second receiving features 50, 55 of the first plumbing outlet box housing 10 and engagement of one of the first or second receiving features 50', 55' of the second plumbing outlet box housing 10' with a corresponding one of the first or second mounting tabs 60, 65 of the first plumbing outlet box housing 10. In the example illustrated in FIG. 9, for example, the first receiving feature 50 of the first plumbing outlet box housing 10 is engaged with the second mounting tab 65' of the second plumbing outlet box housing 10', and the first mounting tab 60 of the first plumbing outlet box housing 10 is engaged with the second receiving feature 55' of the second plumbing outlet box housing 10'. Moreover, due to the rotational symmetry of the placement of the respective receiving features and mounting tabs, the first and second plumbing outlet box housings 10, 10' may be configured to be engaged to each other regardless of the relative orientation of the two plumbing outlet box housings. In other words, in some embodiments, one or both of the plumbing outlet boxes 5, 5' shown in FIG. 9 may be rotated by 180° from the orientation shown (and/or from the orientation of the other of the two plumbing outlet boxes) while still maintaining the ability to be attached to each other as described above.

In this regard, in some cases, the first and second plumbing outlet box housings 10, 10' may be identical (e.g., have identical configurations). For the purposes of the description herein, the term "identical" does not preclude the existence of a certain imperfections and differences within an acceptable degree of manufacturing tolerance as understood in the art. Rather, the configuration of each plumbing outlet box 5, 5' may be such that the size, number, position, function, etc. of the connections and openings for making such connections are the same.

Accordingly, a single configuration of a plumbing outlet box (such as the configuration of the plumbing outlet box 5 shown in FIG. 1, for example) may be used as a "universal" plumbing outlet box, with some or all of the available connections being used as desired to accommodate the particular installation scenario and with the particular orientation of the plumbing outlet box selected to optimize the use of the connections. Referring again to FIG. 1, for example, the plumbing outlet box 5 may be configured such that the top wall 20 and the bottom wall 25 each includes drain openings 85, 90. The top drain opening 85 may, for example, have a diameter of 1½ inches, whereas the bottom drain opening 90 may, for example have a diameter of 2 inches. In other embodiments, however, the drain openings 85, 90 may be the same size as each other or different sizes, and the sizes may be larger or smaller than those described herein to accommodate different consumer requirements and usage scenarios. In still other embodiments, at least one of the top wall and the bottom wall may also include a pair of laterally-spaced openings 92, 94 configured to accommodate hot and cold water supply connections, such as to allow the plumbing outlet box 5 to be used in a washing machine installation.

As noted above, due to the rotational symmetry of the placement of the receiving features and mounting tabs, the plumbing outlet box 5 may be orientated as shown in FIG. 1 or in an orientation that is rotated by 180° from the orientation shown in FIG. 1. In FIG. 10, for example, the plumbing outlet box 5 is oriented as shown in FIG. 1, such that the two laterally-spaced openings 92, 94 and one of the drain openings 85 are facing up and the other drain opening 90 is facing down. In the orientation shown in FIG. 10, the two laterally-spaced openings 92, 94 may be used to accommodate hot and cold water supply connections, and the drain opening 90 may be used to receive effluent (e.g., from a washing machine).

In contrast, in FIG. 11, the same plumbing outlet box 5 shown in FIG. 1 is rotated by 180° from the orientation shown in FIGS. 1 and 10. For example, in FIG. 11, the two laterally-spaced openings 92, 94 and one of the drain openings 85 are facing down and the other drain opening 90 is facing up. In the orientation shown in FIG. 11, the two laterally-spaced openings 92, 94 may be used to accommodate hot and cold water supply connections, where the connections are made from the bottom. The downward-facing drain opening 85 in the depicted example is plugged, whereas the upward-facing drain opening 90 is available. Despite the difference in orientations between the plumbing outlet boxes 5 shown in FIGS. 10 and 11, the plumbing outlet box of FIG. 10 may be connected to the plumbing outlet box of FIG. 11 in an assembly as described above without the use of any separate connectors, brackets, or other mounting accessories.

In some embodiments, a faceplate 100 (shown in FIGS. 12-14A) may be provided that is configured to mount to the housing 5, as described in greater detail below. The faceplate 100 may provide the plumbing outlet box 5 with a clean or finished look within the cutout of the drywall panel, such as by hiding the cut edges of the drywall. In some cases, the faceplate 100 may provide other benefits, such as by sealing a climate-controlled interior of the building in which the plumbing outlet box 5 is installed (e.g., the house, apartment building, office building, or other residence or dwelling) from non-climate-controlled portions of the building (e.g., behind the walls of the building, etc.). An example of a faceplate that is used in conjunction with a seal is described in U.S. Publication No. (not yet published, Ser. No. 13/909,728) titled "Plumbing Outlet Box" filed on Jun. 4, 2013, which is incorporated by reference herein.

In the mounted position (e.g., when the plumbing outlet box is installed within the cutout of the drywall panel), the faceplate 100 may contact a portion of the interior surface of the drywall panel. Turning to FIG. 12, for example, the faceplate 100 may include a frame portion 110 and a transverse extension 120 extending substantially perpendicularly (e.g., at an angle of approximately 85° to approximately 95°) from an innermost edge of the frame portion. The frame portion 110 may be configured to lie against an edge of the drywall panel defining the cutout, such that an observer on the interior side of the wall would not see the cutout, but rather would see a clean, finished, and framed plumbing outlet box 5 (e.g., seeing the frame portion 110 of the faceplate 100). The faceplate 100 may, in some cases, be made of plastic material, such as PVC.

The transverse extension 120 of the faceplate 100 may, in turn, be configured to fit within and engage the housing 10 of the plumbing outlet box 5 (shown, e.g., in FIG. 1) so as to hold the housing and faceplate in the installed position with respect to the drywall panel. In this regard, an outer surface of the transverse extension 120 may define serrated ramps 130 (shown in FIGS. 14 and 14A) that are configured to engage a corresponding feature of the housing 10 (not shown). The housing 10 may, for example, define inwardly turned top and bottom edges (not shown) that are configured to progressively engage the serrations of the serrated ramps 130 on the faceplate 100. In this way, the faceplate 100 may be configured to mount to the housing 10 via a snap-fit mounting in some embodiments, such as in embodiments in which serrated ramps 130 and corresponding top and bottom edges of the housing are provided. In other embodiments, the faceplate 100 may be configured to mount to the housing 10 via a screw mounting. In this regard, a side edge of the faceplate 100 may define one or more holes (not shown) configured to receive fasteners (such as screws) for holding the faceplate 100 to the housing 10. In still other embodiments, both engaging features (e.g., serrated ramps 130) and mechanical fasteners (e.g., screws) may be used to assemble and install the faceplate 100 and housing 10 within the cutout in the drywall panel.

Turning again to FIGS. 14 and 14A, in some embodiments, as the faceplate 100 is received by the housing 10 of the plumbing outlet box 5, the serrated edges of the serrated ramps 130 may progressively engage the corresponding inwardly turned upper and lower edges of the housing. The serrated edge may be configured such that the faceplate 100 may be moved in a direction towards the housing (for further engagement of the serrated ramps 130 with the corresponding edges), but the engagement of the ramps with the edges may prevent the faceplate from being disengaged from the housing when an equal force is applied in the opposite direction, providing a ratchet-type effect.

With reference to FIG. 13, in some embodiments, at least a portion of the transverse extension 120 of the faceplate 100 may comprise at least one eyelet 140. Each eyelet 140 may define a hole 145 configured to receive a securing member therethrough. For example, in some cases in which the plumbing outlet box 5 is configured and oriented as depicted in FIG. 10, a pair of eyelets 140 may be provided along a bottom transverse extension 120, where the eyelets are configured to receive securing members, such as cable ties, therethrough for securing a drain hose (such as the hose shown in FIG. 10) in place. The eyelets 140 may be equidistantly spaced from the bottom corners of the faceplate 100. In installations of modern high efficiency washers, for example, the force at which the machine pump discharges the water can cause the drain hose to come out of the drain. By securing the drain hose via a cable tie and the eyelets 140, as described above, the drain hose may thus resist disengagement from the drain.

Accordingly, as described above, a method of installing a plumbing outlet box assembly comprising at least two plumbing outlet boxes within a wall is described that includes providing first and second plumbing outlet boxes. Each plumbing outlet box may have a housing that includes a top wall, a bottom wall, first and second side walls, and an opening providing access into an interior of the housing. As described above with respect to the figures, a first receiving feature may extend outwardly from the first side wall; a second receiving feature may extend outwardly from the second side wall; a first mounting tab may extend outwardly from the first side wall; and a second mounting tab may extend outwardly from the second side wall. The first receiving feature may be located proximate the top wall and the second receiving feature may be located proximate the bottom wall. Likewise, the first mounting tab may be located proximate the bottom wall, and the second mounting tab may be located proximate the top wall.

In some embodiments, the second plumbing outlet box housing may be engaged to the first plumbing outlet box housing via engagement of one of the first or second mounting tabs of the second plumbing outlet box housing with a corresponding one of the first or second receiving features of the first plumbing outlet box housing and engagement of one of the first or second receiving features of the second plumbing outlet box housing with a corresponding one of the first or second mounting tabs of the first plumbing outlet box housing. The first plumbing outlet box housing may be fastened within the cutout, as described above, and the second plumbing outlet box housing may also be fastened within the cutout.

Moreover, the first plumbing outlet box and the second plumbing outlet box may be fastened within the cutout by inserting a fastener through an opening on the respective receiving feature, as described above. For example, each receiving feature of the first and second plumbing outlet boxes may comprise a pair of lateral receiving arms and a main receiving arm disposed therebetween. Fastening the first plumbing outlet box within the cutout may comprise inserting a fastener through an opening in the respective lateral receiving arms of the first plumbing outlet box and inserting a fastener through an opening in the main receiving arm of the first plumbing outlet box following engagement of the second plumbing outlet box housing to the first plumbing outlet box housing. Fastening the second plumbing outlet box within the cutout may comprise inserting a fastener through a slot in the mounting tab of the second plumbing outlet box and the opening in the corresponding main receiving arm of the first plumbing outlet box following engagement of the second plumbing outlet box housing to the first plumbing outlet box housing. In other embodiments, however, at least some of the fasteners may be applied to the first plumbing outlet box prior to engaging the second plumbing outlet box housing to the first plumbing outlet box housing.

In some cases, such as where a "universal" plumbing outlet box configuration is used, the first plumbing outlet box housing may be configured to be similar to the second plumbing outlet box housing, as described above.

As noted above, the structures and components depicted in the figures have been simplified for clarity and ease of explanation. As such, the shape of the housing, components of the housing or held within the housing interior (e.g., doors, fittings, connections, etc.) and/or external ductwork, connections, appliances, etc., although described above, may not be shown in the figures. Moreover, although particular configurations of the plumbing outlet box 5 and faceplate 100 are shown in FIGS. 1-14A, other types, sizes, and shapes of plumbing outlet boxes and faceplates may benefit from embodiments of the present invention.

For example, although the foregoing examples and figures describe a configuration of a plumbing outlet box that includes a pair of laterally-spaced openings and one drain opening defined in one wall and another drain opening defined in an opposite wall of the housing, in other configurations no drain openings may be provided, the drain openings may be provided in only one wall, or more than one drain opening may be provided in one or both walls. Moreover, in some cases, no openings may be provided in the housing, a single opening may be provided in one or both walls of the housing, more than two openings may be provided in one or both walls of the housing, or other connection features other than openings and drains may be provided, as needed to satisfy user requirements and/or preferences.

Furthermore, although the embodiments provided in the examples and illustrated in the figures describe receiving features each including a pair of lateral receiving arms and a main receiving arm disposed therebetween that are configured to engage a slotted mounting tab (e.g., a ratcheted mounting tab as depicted), other types of engagement mechanisms may be used to engage the receiving features with the corresponding mounting tabs. As one example, instead of providing ratchets on the back surface of the main receiving arm, one or more pins (e.g., chamfered pins) may be provided that are configured to engage corresponding holes or concavities formed in the mounting tab. The pins and holes may be configured (e.g., sized and shaped) such that upon engagement of the receiving feature with a corresponding mounting tab, the pin(s) of the receiving feature fit within the corresponding hole(s) of the mounting tab, thereby maintaining the receiving feature and mounting tab in an engaged position. As other examples, the receiving feature may be structure to engage with a corresponding mounting tab via a friction fit, snap fit, or any other type of securing mechanism, as will be understood by one skilled in the art in light of this disclosure. Moreover, rather than having a pair of lateral receiving arms and a main receiving arm, in some embodiments each receiving feature may be structured to have any number of arms, such that in some embodiments no receiving channel may be defined.

In addition, many other modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Moreover, steps in the methods described above may occur in any order and are not limited to the order described above.

What is claimed is:

1. A plumbing outlet box configured for mounting within a wall, said plumbing outlet box comprising:

a housing including a top wall, a bottom wall, first and second side walls, and an opening providing access into an interior of the housing;

a first receiving feature extending outwardly from the first side wall;

a second receiving feature extending outwardly from the second side wall;

a first mounting tab extending outwardly from the first side wall; and a second mounting tab extending outwardly from the second side wall, wherein the first receiving feature is located closer to the top wall than the first mounting tab and the second receiving feature is located closer to the bottom wall than the second mounting tab, wherein at least one of the receiving features is configured to receive an engaging mounting tab of a second plumbing outlet box and at least one of the mounting tabs is configured to be received by an engaging receiving feature of the second plumbing outlet box, wherein each receiving feature comprises a pair of lateral receiving arms and a main receiving arm disposed therebetween configured to opposingly engage the engaging mounting tab, and wherein each of the lateral receiving arms and the main receiving arm includes an opening configured for receiving a fastener.

2. The plumbing outlet box according to claim 1, wherein the main receiving arm and a portion of each lateral receiving arm define a receiving channel configured to receive the engaging mounting tab.

3. The plumbing outlet box according to claim 1, wherein each lateral receiving arm defines a ledge extending toward the other lateral receiving arm of the pair of lateral receiving arms, wherein a surface of the ledge is configured to support a corresponding surface of the engaging mounting tab.

4. The plumbing outlet box according to claim 1, wherein each mounting tab includes a slot configured for receiving a fastener.

5. The plumbing outlet box according to claim 1, wherein the main receiving arm includes a series of angled ridges configured to engage a series of complementary angled ridges on the engaging mounting tab.

6. The plumbing outlet box according to claim 1, wherein the receiving features and the mounting tabs are integral with the housing.

7. The plumbing outlet box according to claim 1, wherein the top wall and the bottom wall each include drain openings.

8. The plumbing outlet box according to claim 7, wherein at least one of the top wall or the bottom wall also includes a pair of laterally spaced openings configured to accommodate hot and cold water supply connections.

9. A method of installing a plumbing outlet box assembly comprising at least two plumbing outlet boxes within a cutout in a wall, said method comprising:

providing first and second plumbing outlet boxes each having a housing that includes a top wall, a bottom wall, first and second side walls, and an opening providing access into an interior of the housing, wherein a first receiving feature extends outwardly from the first side wall, a second receiving feature extends outwardly from the second side wall, a first mounting tab extends outwardly from the first side wall, and a second mounting tab extends outwardly from the second side wall, such that the first receiving feature is located closer to the top wall than the first mounting tab and the second receiving feature is located closer to the bottom wall than the second mounting tab;

engaging the second plumbing outlet box housing to the first plumbing outlet box housing via engagement of one of the first or second mounting tabs of the second plumbing outlet box housing with a corresponding one of the first or second receiving features of the first plumbing outlet box housing and engagement of one of the first or second receiving features of the second plumbing outlet box housing with a corresponding one of the first or second mounting tabs of the first plumbing outlet box housing; and fastening at least one of the first plumbing outlet box housing or the second plumbing outlet box housing within the cutout, wherein each receiving feature of the first and second plumbing outlet boxes comprises a pair of lateral receiving arms and a main receiving arm disposed therebetween, and wherein fastening the first plumbing outlet box within the cutout comprises inserting a fastener through an opening in the respective lateral receiving arms of the first plumbing outlet box and inserting a fastener through an opening in the main receiving arm of the first plumbing outlet box following engagement of the second plumbing outlet box housing to the first plumbing outlet box housing.

10. The method of claim 9, wherein fastening at least one of the first or second plumbing outlet box housings within the cutout comprises inserting a fastener through an opening on the respective receiving feature.

11. The method of claim 9, wherein fastening the second plumbing outlet box within the cutout comprises inserting a fastener through a slot in the mounting tab of the second plumbing outlet box and the opening in the corresponding main receiving arm of the first plumbing outlet box following engagement of the second plumbing outlet box housing to the first plumbing outlet box housing.

12. An assembly of plumbing outlet boxes comprising:

at least a first plumbing outlet box and a second plumbing outlet box each configured for mounting within a wall and each comprising:

a housing including a top wall, a bottom wall, first and second side walls, and an opening providing access into an interior of the housing, wherein a first receiving feature extends outwardly from the first side wall, a second receiving feature extends outwardly from the second side wall, a first mounting tab extends outwardly from the first side wall, and a second mounting tab extends outwardly from the second side wall, such that the first receiving feature is located closer to the top wall than the first mounting tab and the second receiving feature is located closer to the bottom wall than the second mounting tab, wherein the second plumbing outlet box housing is configured to be engaged with the first plumbing outlet box housing via engagement of one of the first or second mounting tabs of the second plumbing outlet box housing with a corresponding one of the first or second receiving features of the first plumbing outlet box housing and engagement of one of the first or second receiving features of the second plumbing outlet box housing with a corresponding one of the first or second mounting tabs of the first plumbing outlet box housing, wherein the first and second plumbing outlet box housings are configured to be engaged to each other regardless of the relative orientation of the two plumbing outlet box housings, wherein each receiving feature of the first and second plumbing outlet box housings comprises a pair of lateral receiving arms and a main receiving arm disposed therebetween configured to opposingly engage a corresponding mounting tab of the other of the first or second plumbing outlet box housings, and wherein each of the lateral receiving arms and the main receiving arm of the first and second plumbing outlet box housings includes an opening configured for receiving a fastener, and wherein each of the mounting tabs of the first and second plumbing outlet box housings includes a slot configured for receiving a fastener.

13. The assembly of claim 12, wherein the first and second plumbing outlet box housings are similarly configured.

14. The assembly of claim 12, wherein the second plumbing outlet box housing is oriented 180° from the orientation of the first plumbing outlet box housing.

* * * * *